US006503181B1

(12) United States Patent
Pons

(10) Patent No.: US 6,503,181 B1
(45) Date of Patent: Jan. 7, 2003

(54) MACHINE FOR GLUING FOLDING CARTONS FOR PRODUCING FOLDING CARTONS FROM BLANKS

(75) Inventor: Hubert Pons, Neuss (DE)

(73) Assignee: Jagenberg Diana GmbH, Neuss (DE)

( * ) Notice: Subject to any disclaimer, the term of this patent is extended or adjusted under 35 U.S.C. 154(b) by 0 days.

(21) Appl. No.: 09/463,889

(22) PCT Filed: Jun. 1, 1999

(86) PCT No.: PCT/EP99/03786

§ 371 (c)(1),
(2), (4) Date: Jan. 31, 2000

(87) PCT Pub. No.: WO99/62701

PCT Pub. Date: Dec. 9, 1999

(30) Foreign Application Priority Data

Jun. 4, 1998 (DE) ..... 198 24 985
Jun. 27, 1998 (DE) ..... 198 28 820

(51) Int. Cl.[7] ..... B31B 1/62

(52) U.S. Cl. ..... 493/130; 493/134; 493/141; 493/182; 198/419.2

(58) Field of Search ..... 198/419.2; 493/130, 493/150, 151, 134, 141, 142, 182

(56) References Cited

U.S. PATENT DOCUMENTS 1,972,021 A 8/1934 Labombarde
3,577,665 A * 5/1971 Kamberg
4,012,996 A * 3/1977 Stolkin et al.
4,106,397 A * 8/1978 Amberg et al.
4,547,183 A * 10/1985 Mowry
4,699,031 A * 10/1987 D'Angelo et al.
4,754,541 A * 7/1988 Dorner et al.
4,815,252 A * 3/1989 Renard et al.
5,149,075 A * 9/1992 Crowley et al.
5,807,223 A * 9/1998 Holton

FOREIGN PATENT DOCUMENTS

DE 31 39 290 A1 8/1982
GB 2 284 178 A 5/1995

* cited by examiner

*Primary Examiner*—Eugene Kim
(74) *Attorney, Agent, or Firm*—Herbert Dubno

(57) ABSTRACT

A collapsible-box gluing machine for the production of collapsible boxes from blanks has a folding station for folding blanks, a subsequently arranged transfer station and a collecting and compression device, wherein the flat-lying folded collapsible boxes are pressed for the bonding of the adhesive. The transfer station has at least one pair of conveyor belts as a conveying device, which consists of a lower belt and an upper belt. In order to transfer the blanks with precisely positioned side flaps to the collecting and compression device, the transfer station has a variable ratio transmission to drive the upper conveyor belts at a higher speed than the lower conveyor belts.

4 Claims, 2 Drawing Sheets

MACHINE FOR GLUING FOLDING CARTONS FOR PRODUCING FOLDING CARTONS FROM BLANKS

The invention relates to a collapsible-boxes gluing machine for producing collapsible boxes from blanks, with a folding station wherein the blanks provided with an adhesive strip are folded, a subsequently arranged transfer station, which has at least one conveyor belt pair consisting of a lower belt and an upper belt, and a collecting and compression device, wherein the flat-lying folded collapsible boxes are pressed for the bonding of the adhesive,

STATE OF THE ART

As known, collapsible-boxes gluing machines for producing collapsible boxes from blanks have several processing stations, which are successively traversed by the blanks/boxes.:

First the blanks are picked up one after the other from a stack in a high-speed feeder and fed individually directly to a folding station or at first to a so-called preliminary crusher, which precedes the folding station. In the folding station the blank parts provided with a glue strip are turned over by 180°, i.e. folded, for the purpose of producing an adhesive connection. In the preliminary crusher the folding flaps are folded back and forth prior to the application of the adhesive, so that the corresponding longitudinal groove lines are softened and made more pliant.

The folding station is normally followed by a so-called transfer station, where the boxes can be counted, marked and—if defective—thrown out. Then follows a collection and compression device, wherein at first a scaled stream of folded blanks is formed, which subsequently is kept under pressure for a while between compression belts, so that the two blank parts are connected at the gluing seam. The final stage is usually a packaging device, where the flat, folded collapsible boxes are packaged in cartons.

The transfer station has the primary task of feeding the blanks provided with an adhesive which has not yet bonded to the collecting and compression device with all their parts correctly positioned. Between the compression belts of the collecting and compression device, the box parts to be bonded are fixed one on top of the other, in the shape they are conveyed. This leads to the fact that the relative position of two box parts with respect to each other can there no longer be corrected.

As known, the folded blanks are transported through the stations by means of two conveyor belt pairs, arranged at a distance from each other, so that they guide the blanks holding them from above and below on their sides. In boxes where on each longitudinal side a side flap, which is pressed down respectively by a lateral belt has to be overturned, in the folding station the undesirable so-called "fish-tail effect" can occur: By fish-tail effect one understands a relative displacement of the upper box parts, of the overturned side flaps to the lower box parts of the bottom, to the extent that the side flaps are slightly turned inwards in the front, i.e. their longitudinal edge is no longer precisely parallel to the longitudinal edges of the bottom. This undesired displacement is caused by the fact that the folding belt lifts the side flaps to be overturned in front, in the running direction.

DESCRIPTION OF THE INVENTION

It is the object of the invention to improve a generic collapsible-boxes gluing machine so that the folded blanks are transferred to the compression belts of the collecting and compression device with precisely positioned side flaps. This object is achieved with the features of claim 1.

According to the invention, in the transfer station the speed of the upper conveyor belt can be increased in relation to the speed of the lower conveyor belt, in order to displace the upper box parts in relation to the lower box parts, for the purpose of correcting the fish-tail effect.

The dependent claims contain preferred, particularly advantageous embodiments of the invention.

BRIEF DESCRIPTION OF THE DRAWING

The drawing serves for the clarification of the invention with reference to a simplified representation of an embodiment example.

WAYS TO IMPLEMENT THE INVENTION

Seen in conveying direction (from right to left), the collapsible-boxes machine starts with a feeder 1, which picks up at high speed the blanks to be processed one after the other from a stack and feeds them separately to the subsequent processing station. The feeder 1 is followed by a preliminary crusher 2, which in the present embodiment example is designed in two stages. The preliminary crusher comprises folding elements, in order to fold folding flaps back and forth, so that the corresponding longitudinal groove lines are made soft and pliable by being bent at 180°. The two-stage design makes it possible to crush more longitudinal and transverse lines and to provide additional folds. In the case of certain box shapes, adhesive applicators are arranged already within the preliminary crusher, in order to apply additional adhesive strips in longitudinal direction. The next work station following the preliminary crusher 2 is the folding station 3, at whose initial part an adhesive applicator 4, normally for glue, is arranged. The adhesive applicator 4 comprises glue nozzles or glue plates which apply strips of glue to the blanks. Subsequently the folding flaps of the blanks are folded by folding elements.

Figure 1:
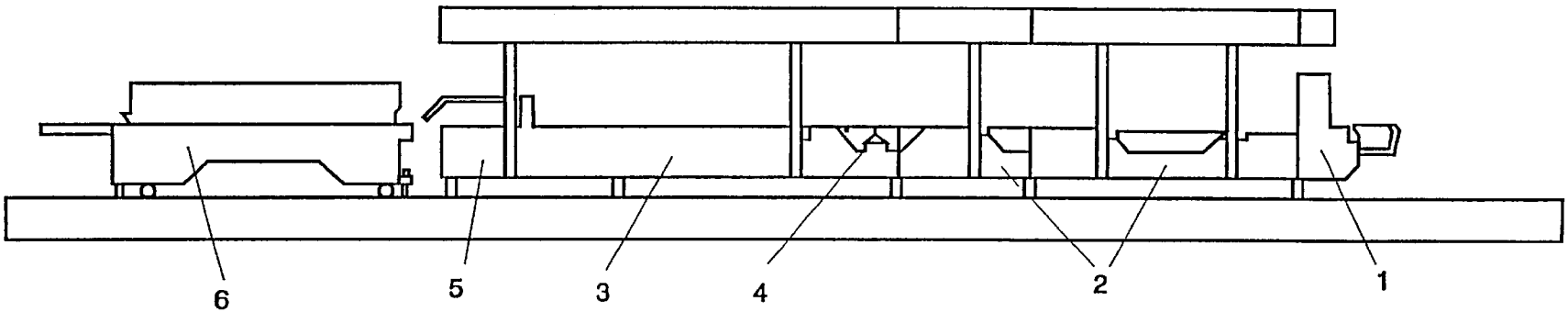
FIG. 1 shows a schematic side view of the individual stations of a collapsible-boxes gluing machine.
Figure 2:
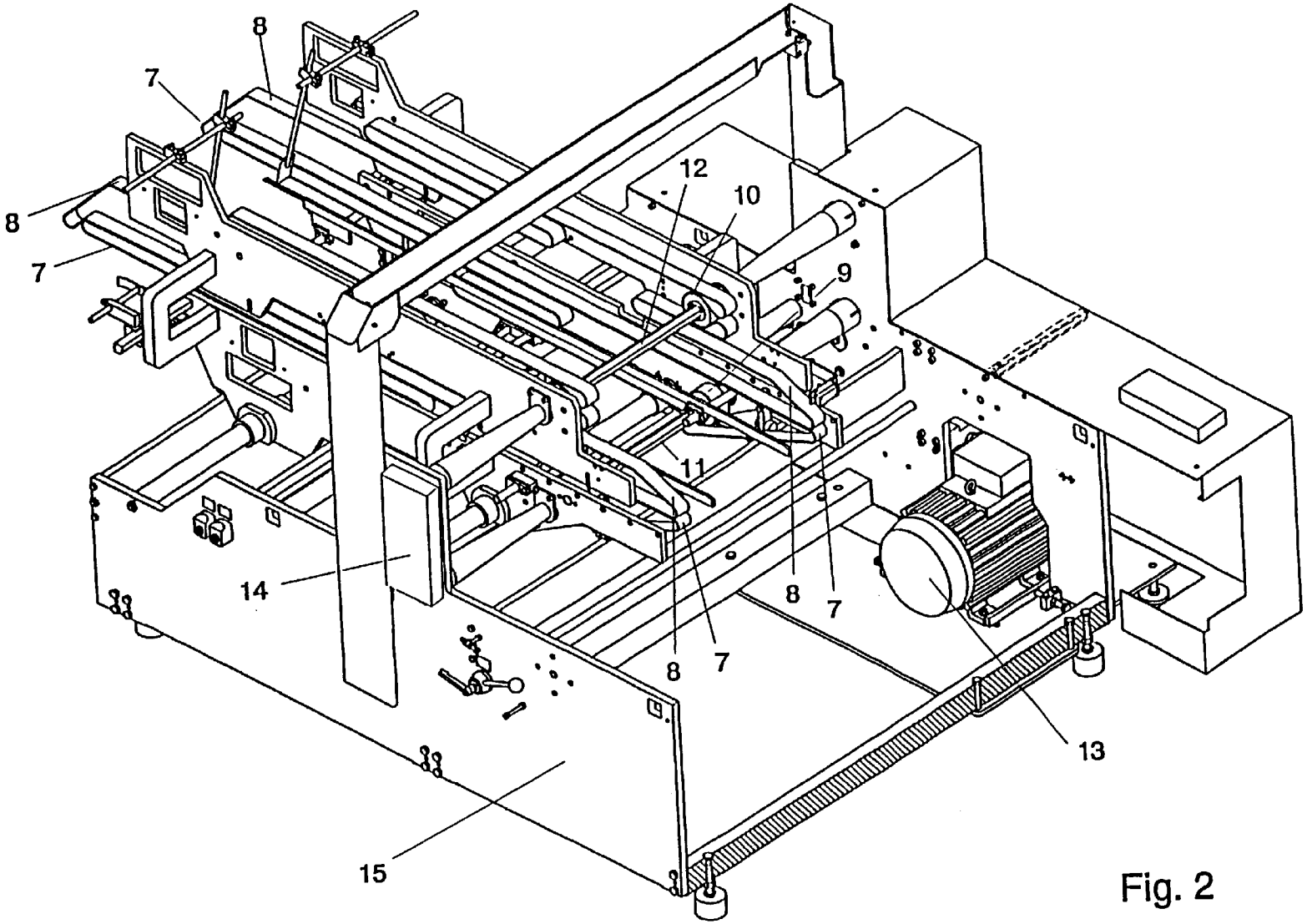
FIG. 2 shows a perspective view of the construction of a transfer station.

In FIG. 2 the construction of a transfer station is shown in detail:

As a conveying device for the blanks the transfer station 5 comprises two parallel belt pairs arranged at a distance from each other and extending in the conveying direction, each consisting of a lower belt 7 and an upper belt 8. The folded blanks are conveyed lying between the top strand of the lower belt 7 and the bottom strand of the upper belt 8, whereby the upper belts 8 press down the overturned side flaps of the blanks. In FIG. 2 the conveying direction of the belts 7, 8 runs from bottom right to top left.

Each of the lower conveyor belts 7 runs around a belt pulley 9, which sits transversely displaceable on a driven polyhedral shaft 11. Correspondingly the upper conveyor belts 8 runs around belt pulleys 10, which are mounted transversely displaceable on a driven polyhedral shaft 12. Both belt pairs 7, 8 can be positioned transversely so that they can adjust their work position to the respective box format.

The drive shaft 11 of the lower belts 7 is driven from the central drive 13 of the collapsible-boxes gluing machine. The drive shaft 12 of the upper belts 8 is also driven by the lower shaft 11 via a transmission 14 with variable transmission ratio. Preferably the transmission 14 connecting both shafts 11, 12 is a traction means transmission, particularly a belt transmission, which is fastened outside on the lateral wall 15 of the machine, on the operator side. For instance a flat or wedge belt transmission with an adjustable taper drive is used.

The transmission 14 is so designed with variable transmission ratio that the ratio of the conveying speed of the upper belts 8 to the speed of the lower belts 7 can be steplessly varied from 1:1 to 1.1:1. The conveying speed of the upper belts 8 can therefore be increased with respect to the conveying speed of the lower belts 7 precisely by the value required for moving the upper box parts in the correct position with respect to the lower box parts.

I claim:

1. A collapsible-box gluing machine for producing collapsible boxes from blanks, said gluing machine comprising:

a folding station through which blanks provided with adhesive strips are advanced and wherein the blanks provided with the adhesive strips are folded;

a collecting and compression device spaced from said folding station along a path of said blanks and wherein flat-lying folded collapsible boxes are pressed for bonding by the adhesive strips; and a transfer station downstream of said folding station and upstream of said device along said path for delivery of folded blanks from said folding station to said device, said transfer station having two pairs of belts engaging said folded blanks between them, each pair including an upper belt having a lower stretch engaging the folded blanks and a lower belt having an upper stretch engaging the folded blanks, and a variable-ratio transmission connecting the upper belts and the lower belts for driving said upper belts at a higher speed than said lower belts, said belts lying wholly downstream of said folding station.

2. The collapsible-box gluing machine defined in claim 1 wherein said transmission is a belt transmission.

3. The collapsible-box gluing machine defined in claim 2 wherein said machine has a machine drive, said lower belts having a drive shaft connected to said drive and said upper belts being connected to said drive shaft by said transmission.

4. The collapsible-box gluing machine defined in claim 3 wherein said drive shaft and a driven shaft for said upper belts are polygonal-section shafts on which wheels for the respective belts are axially shiftable.

* * * * *